US006383078B1

(12) United States Patent
Yacenda

(10) Patent No.: US 6,383,078 B1
(45) Date of Patent: May 7, 2002

(54) ON-LINE LOTTERY GAME SYSTEM

(75) Inventor: Michael W. Yacenda, Stamford, CT (US)

(73) Assignee: eLottery, Inc., Norwalk, CT (US)

( * ) Notice: Subject to any disclaimer, the term of this patent is extended or adjusted under 35 U.S.C. 154(b) by 0 days.

(21) Appl. No.: 09/528,487

(22) Filed: Mar. 17, 2000

(51) Int. Cl.[7] ..... A63F 17/00
(52) U.S. Cl. ..... 463/41; 463/42; 463/40
(58) Field of Search ..... 463/16–19, 25, 463/29–30, 40–42; 700/91–93; 379/88.17, 88.19

(56) References Cited

U.S. PATENT DOCUMENTS 5,119,295 A * 6/1992 Kapur ..... 364/412
5,679,077 A * 10/1997 Pocock et al. ..... 463/19
5,707,289 A * 1/1998 Watanabe et al. ..... 463/40
5,722,890 A * 3/1998 Libby et al. ..... 463/17
5,904,619 A * 5/1999 Scagnelli et al. ..... 463/17
5,983,196 A * 11/1999 Wendkos ..... 705/14
6,024,641 A * 2/2000 Sarno ..... 463/17
6,152,824 A * 11/2000 Rothschild et al. ..... 463/42
6,202,023 B1 * 3/2001 Hancock et al. ..... 701/201

* cited by examiner

*Primary Examiner*—Jessica J. Harrison
*Assistant Examiner*—Alex F. R. P. Rada, II
(74) *Attorney, Agent, or Firm*—F. Chau & Associates, LLP

(57) ABSTRACT

A system and a method is provided for facilitating on-line lottery games over the Internet. The system includes terminals each having a modem for connecting to a service provider server for accessing the electronic network, and an agent server for storing criteria required for playing the lottery games, for verifying information received from the service provider server with the criteria, and for providing lottery games to the terminals. The service provider server receives information associated with a player when the player requests access to the electronic network from one of the terminals. The agent server is connected to the service provider server for receiving the information from the service provider server when the player is routed to the agent server.

18 Claims, 9 Drawing Sheets

WELCOME TO E-LOTTERY WEBSITE!

E-LOTTERY WEBSITE MEMBERSHIP
(Please fill in the followings)

E-MAIL ADDRESS

PASSWORD

CONFIRM PASSWORD

PASSWORD HINT

FIRST NAME

MIDDLE NAME

LAST NAME

DATE OF BIRTH

GENDER

ADDRESS

TELEPHONE NO.

Fig. 6

TICKET CONFIRMATION NUMBER 1 2 3 4 5 6

YOUR TICKET INFORMATION

| Bet Type | Played No. | Winning No. | Prize |
|---|---|---|---|
| Straight | 7 8 9 | | 5000 e-points |

This confirmation number is valid for the drawing to be held on Monday 3-13-00 at 6:00 PM.

ON-LINE LOTTERY GAME SYSTEM

FIELD OF THE INVENTION

The present invention relates to a system and a method for facilitating on-line lottery games via an electronic network, more particularly to a system and a method for facilitating on-line lottery games with a function of verifying subscriber information.

BACKGROUND OF THE INVENTION

Lottery games are gaining in popularity, and lottery players are often required to travel to a local lottery agent at stores and to wait on line to purchase lottery tickets. Lottery players are interested in being able to play in a comfortable setting such as lottery players' homes instead of having to travel to purchase the tickets.

The advent of global electronic networks such as the Internet facilitates on-line lottery game playing. Lottery players can participate in lottery games at physically different locations via the Internet. That is, lottery players can place their wagers using terminals, such as personal computers, lottery terminals and/or any machine capable of accessing the Internet, instead of physically having to go to designated lottery agents. A system for facilitating on-line lottery play is described in a commonly assigned U.S. application, Ser. No. 09/458,326 (attorney docket no. 8438-209) filed on Dec. 10, 1999. The disclosure of which is incorporated by reference herein. However, lottery games such as state-sponsored lotteries require certain prerequisite to play, such as participation of lottery plays only within borders of the state.

A system for remote lottery play by use of conventional telephones has been proposed in U.S. Pat. No. 5,921,865 to Scagnelli et al. Lottery players can place their wagers using telephone keypad to key in ticket numbers in response to prerecorded voice prompts. In such lottery game system, certain conditions for playing lottery games, such as lottery players' residency within borders of the state, can be verified by detecting the origin of calls placed by lottery players. The call origins are locations where the lottery players make calls to participate in lottery games using telephones. The call origins of lottery players can be detected by utilizing automatic number identification (ANI) information provided by telephone service providers such as AT&T, MCI, Sprint, and so forth. The ANI is a service for providing a called station of a telephone call with the number of the calling phone. Telephone number identification using ANI is well known. From the area code or 3-digit exchange number, the state and location of the telephone exchange in which the call is placed can be determined.

However, when subscribers to the Internet play on-line lottery games from personal computers or terminals by logging on to a website providing lottery games via the Internet, the website providing lottery games cannot determine locations of the subscribers by use of the ANI information because the website would typically be accessed through an Internet service provider (ISP) server.

Therefore, it would be advantageous to provide a lottery game system which can provide on-line lottery games over the Internet and determine the locations where subscribers access the Internet to play on-line lottery games provided on a website. It would also be advantageous to provide a lottery game system with verification capability for verifying subscriber information with criteria required for playing on-line lottery games.

SUMMARY OF THE INVENTION

It is an object of the present invention to provide a system and a method for facilitating on-line lottery games with a function of verifying log-on places where lottery players access an electronic network and log on to websites providing the on-line lottery games.

To attain the above and other objects and advantages, a lottery game system according to the present invention includes a plurality of terminals each having a modem for connecting to a service provider server for accessing the electronic network, wherein the service provider server receives information associated with a player when the player requests access to the electronic network from one of the terminals, and an agent server for storing criteria required for playing the lottery games, wherein the agent server is connected to the service provider server for receiving the information when the player is routed to the agent server from the service provider server, for verifying the received information with the criteria, and for providing lottery games to the player. The agent server may include a first database for storing the criteria required for playing the lottery games, a second database for storing the information received from the service provider server, a verification unit for verifying the information with the criteria, and a data process unit for providing control and data signals to the first and second databases and the verification unit.

A method for facilitating on-line lottery games according to the present invention includes accessing the electronic network at a terminal for playing the lottery games, receiving information associated with a player who accesses the electronic network at the terminal, receiving criteria setting forth requirements for playing the lottery games, verifying the information with the criteria, and providing the lottery games to the player of the verified information. The ANI information is generated when the player accesses the Internet, and the caller ID information is generated when the player is routed to the website.

These and other objects, features and advantages of the present invention will become apparent from the following detailed description of illustrative embodiments thereof, which is to be read in connection with the accompanying drawings.

BRIEF DESCRIPTION OF THE DRAWINGS

This disclosure will present in detail the following description of preferred embodiment with reference to the following figures wherein:

FIG. 6 illustrates an example of a registration page of the website provided by an agent server of the present invention;

DESCRIPTION OF PREFERRED EMBODIMENTS

This description discloses a system and a method for facilitating on-line lottery games provided over an electronic network such as the Internet. In order to participate in on-line lottery games, a lottery player needs to previously subscribe to an Internet service and log on to the Internet and jump to a website providing on-line lottery games. When a subscriber accesses the Internet, a telephone service provider generates automatic number identification (ANI) information and the ANI information is provided to an internet service provider (ISP) who provides the Internet. The ISP stores the ANI information associated with the location of the subscriber. When the subscriber is routed to a website providing lottery games, the ISP generates caller identification (ID) information to an agent that provides the website providing on-line lottery games over the Internet. The caller ID information includes the ANI information and is associated with the subscriber.

Figure 1:
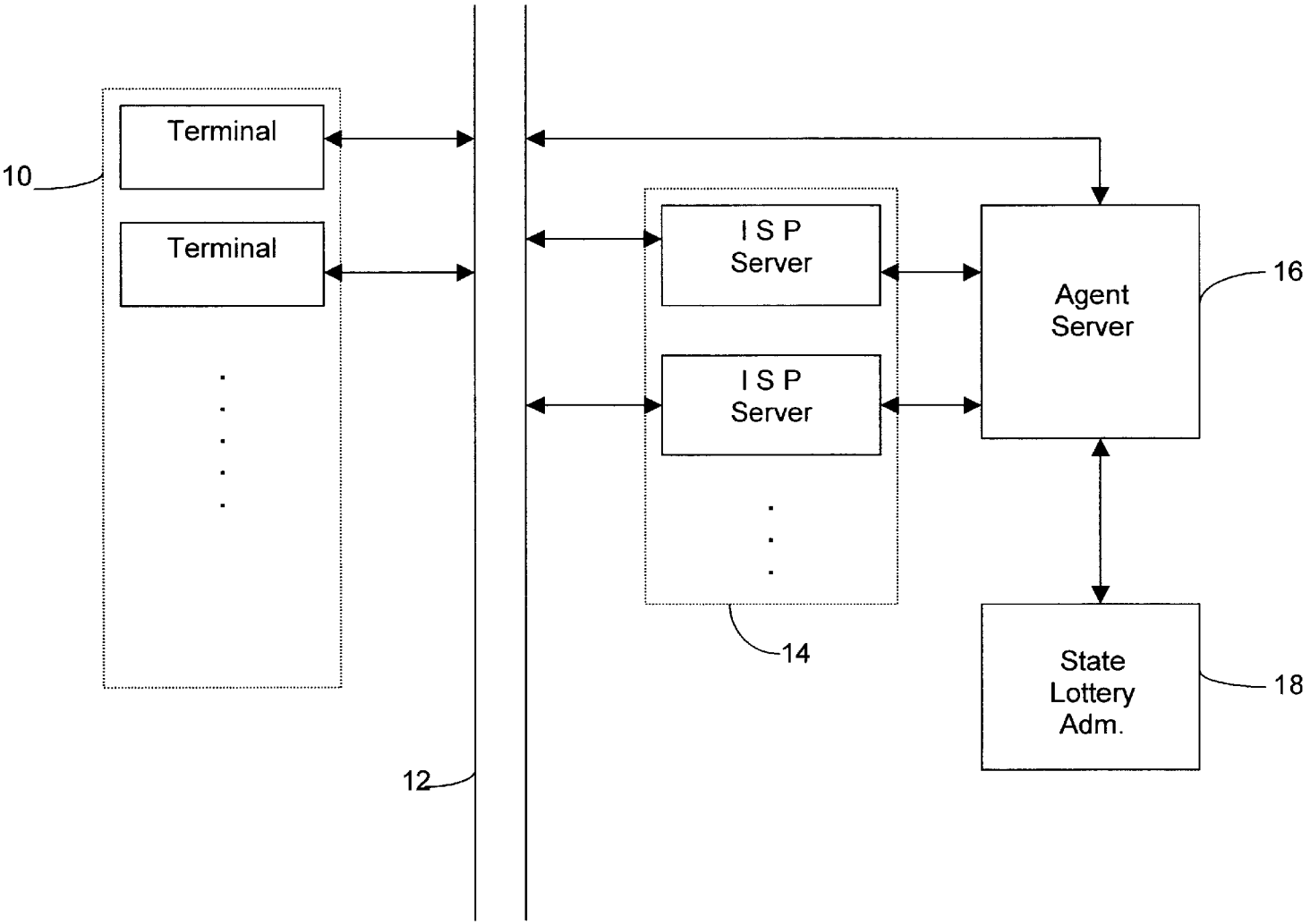
FIG. 1 is a schematic diagram illustrating a lottery game system for providing on-line lottery games over the Internet according to the present invention.

FIG. 1 shows a schematic diagram showing a lottery game system for providing on-line lottery games over the Internet according to the present invention. The lottery game system includes a plurality of terminals 10 where subscribers to the Internet can play on-line lottery games. The terminals 10 may be personal computers, lottery terminals specific for playing lottery games, and/or any machine capable of accessing the Internet. Each subscriber enters at a terminal 10 subscriber information necessary for accessing the Internet for playing on-line lottery games. Each of the terminals 10 has a modem (not shown) connected to a global electronic network 12 such as the Internet. When a subscriber requests access to access the Internet by use of the modem, a telephone service provider (not shown) generates the ANI information associated with the modem, i.e., the location of the terminal 10 where the subscriber accesses the Internet 12. Thus, the ANI information is unique to the location of the terminal 10. The ANI information is generally used for a service that provides a called station of a telephone call with the number of the calling phone. Since the technology relating to ANI is well known to those skilled in this art, detailed description about the ANI is omitted.

When the subscriber logs on to the Internet, the ANI information is provided via the electronic network 12 to one of ISP servers 14 that provides the Internet. The ISP server 14 may have a storage for storing the ANI information received. Since each subscriber needs to enter subscriber information at the time of subscribing for the Internet service, the ISP server 14 receives the subscriber information of each subscriber and may also have a storage for storing the subscriber information such as name and age of the subscriber.

Upon logging on to the Internet, the subscriber is routed to a lottery website provided by an agent server 16. The agent server 16 stores various lottery games, for example state lottery games offered by the states, and selectively provides the lottery games on the lottery website. When the subscriber is routed to the website, the agent server 16 is provided with caller ID information from the ISP server 14. The caller ID information includes the ANI information received from a telephone service provider and the subscriber information received from the subscriber. Thus, the caller ID information is unique to each subscriber and also associated with the location of the subscriber.

With the caller ID information, the agent server 16 verifies certain requirements for playing on-line lottery games. Such requirements are set as criteria by the state such as a state lottery administrator 18. The criteria provided by the state lottery administrator 18 may be previously stored in the agent server 16. The criteria as prerequisite to play lottery games may include, for example, minimum age of lottery players, lottery plays within the borders of the state, and so on. Thus, the agent server 16 verifies the caller ID information, i.e., the location of the subscriber and the subscriber information, with the criteria.

In case of the verification of the location of the subscriber, the agent server 16 determines whether the subscriber accesses the Internet within the state. By using the ANI information included in the caller ID information, the agent server 16 determines the location where the subscriber logs on to the Internet. Since the ANI information is previously generated in association with the location of the subscriber, the location can be determined by using the ANI information or by extracting at least a necessary portion from the ANI information. More detail description of such verification by the agent server 16 follows.

Figure 2:
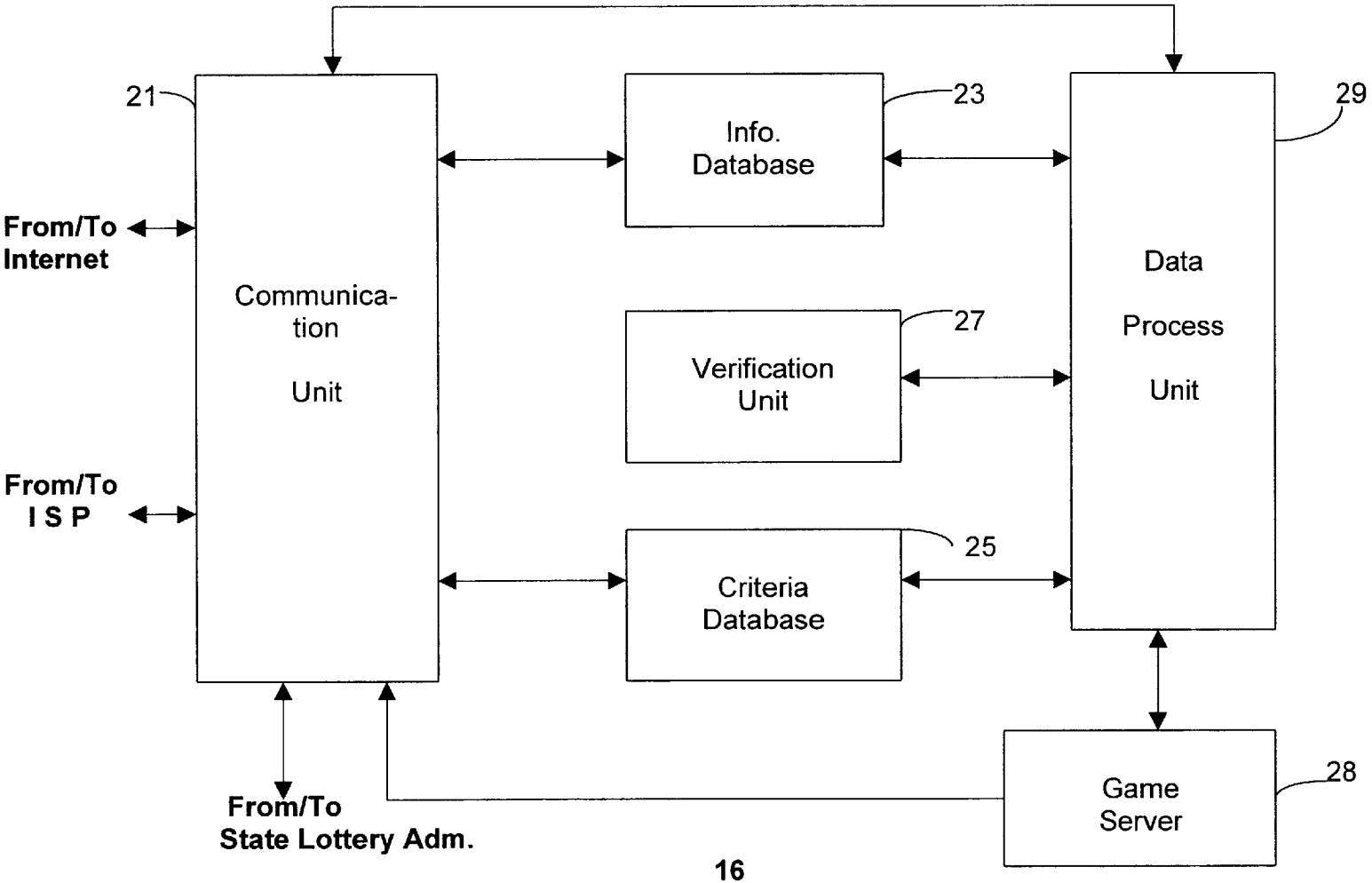
FIG. 2 is a block diagram illustrating a preferred embodiment of the agent server in FIG. 1.

Referring to FIG. 2, the agent server 16 preferably includes a communication unit 21 for providing a communication path between the agent server 16 and the Internet, an information database 23 for storing the caller ID information, a criteria database 25 for storing the criteria, a verification unit 27 for verifying subscriber information with the criteria, a game server 28 for storing and providing various lottery games, and a data process unit 29 for communicating control and data signals with the above and other components in the agent server 16.

When a subscriber requests access to the Internet, an ISP server providing the Internet receives information associated with location of the subscriber, such as the ANI information. A subscriber may request access to the agent server website by specifying the agent's website name in Hypertext Transfer Protocol (HTTP) format (e.g., http://www.elottery.com). The communication unit 21 of the agent server 16 receives an information packet including the caller ID information from the ISP server when the subscriber is routed to the lottery website of the agent server. The communication unit 21 may adopt TCP/IP (Transmission Control Protocol/Internet Protocol) as a communication protocol. TCP/IP uses a client-server model of communication in which a client (i.e., the terminal 10) requests and is provided a service (such as sending a Web page) by another computer (i.e., the agent server 16) in a network.

The information packet including the caller ID information may be included in, for example, "cookies" of the subscribers. A "cookie" is well known to those skilled in this art as information for future use that is stored, by an Internet service provider or on a user side, of information about the subscriber. Such caller ID information from the ISP server is preferably transferred from the communication unit 21 to the information database 23 and stored therein. The communication unit 21 also receives the criteria set and provided by the state lottery administrator 18 (referring to FIG. 1). The criteria is transferred from the communication unit 21 to the criteria database 25 and stored therein. The transmission of the caller ID information and the criteria from the communication unit 21 to the information database 23 and the criteria database 25, respectively, is performed under control of the data process unit 29. The criteria may be previously provided by the state lottery administrator and stored in the criteria database 25.

Under the control of the data process unit 29, the verification unit 27 verifies based on the criteria a subscriber who has accessed the Internet and is routed to the agent server 16. The verification includes verification of the location of the subscriber and the subscriber information. In case of the verification of the location, that is, whether the location of the subscriber falls within the borders of the state, the verification unit 27 first determines from the ANI information included in the caller ID information the location where the subscriber requests access to the Internet, and then verifies the determined location with the criteria retrieved from the criteria database 25. During the verification, the verification unit 27 compares the location of the subscriber with the criteria designating the borders of the state. If the location falls within the borders of the state, the location of the subscriber is successfully verified so that the subscriber may be allowed to participate in on-line lottery games provided on the lottery website.

Upon successfully verifying the location, the game server 28 selectively provides on-line lottery games to a terminal at the verified location under the control of the data process unit 29. That is, the subscriber at the verified location may enter information necessary for playing lottery games, then the information is transferred to the agent server 16 through the Internet. The data process unit 29 of the agent server 16 controls the game server 28 to selectively provide lottery games to the subscriber in accordance with the information entered by the subscriber. The game server 28 stores various on-line games, for example, trivia games, match games, crossword puzzles, sports games, contests, sweepstakes, and other 'for fun' games. The game server 28 may also provide on-line lottery play, for example, a governmental on-line lottery game offered by the state. For example, in consideration-based games such as sweepstakes, the subscriber along with other players pays to play and receives monetary or prize awards upon winning. The amount of the awards depends on the subscriber's ranking or score against those of other players in the game. In skill-based games such as crossword puzzles and sports games, the games may be progressively changed in levels of difficulty. For example, as the subscriber proceeds to higher levels in playing the game, more skill is required on the part of the subscriber to play or less time is given to the subscriber to play. The levels of difficulty in playing the games may be set by the game server 28 under control of the data process unit 29 and may also be changed by the subscribers. Also, an on-line game provided by the game server 28 may have multiple features such as skill-based feature and consideration-based feature. For example, the game server 28 may provide an on-line sport game in which the subscribers participating in the game may be rewarded for predicting an outcome of actual games, such as NFL football playoff games, and/or certain events, such as 'who will rush for the most yards?', 'who will pass for the most yards?', etc., within the actual games. As an award, a winner of the on-line sport game may be provided with, for example, cash and/or discounts on merchandise during the games. The on-line sport game may also give the subscribers the ability to set up groups within the game and track the results of the group separate from the overall game. In such group play of the on-line sport game, each subscriber of the group may pay and one or more subscribers of the group may receive a predetermined amount upon winning. See commonly assigned patent application, system and method for facilitating play of on-line games (attorney docket no. 8438-206), filed on the same day as the present invention, the disclosure in its entirety is incorporated by reference herein. With respect to a subscriber at an unsuccessfully verified location, the agent server 16 deems the location outside the state so as not to provide on-line lottery games.

The caller ID information may include, besides the ANI information, subscriber information such as names and ages of the subscribers. The agent server 16 may also verify the subscriber information based on the criteria. Assuming that the criteria includes certain minimum age to play state-sponsored lottery games, the agent server 16 verifies the age of the subscriber with the criteria, i.e., the required minimum age. The process of verifying the age of the subscriber is under control of the data process unit 29, and is the same as that of verifying the location of the subscriber. The verification unit 27 accesses the subscriber information in the information database 23 and retrieves data of the subscriber's age. The verification unit 27 also accesses the criteria database 25 and retrieves data of the minimum age required to play lottery games. The verification unit 27 then compares the data of the subscriber's age and the minimum age, and determines whether the subscriber's age is equal to or over the minimum age. If the subscriber's age is less than the minimum age, the subscriber is not successfully verified so that the agent server 16 does not provide lottery games to the subscriber.

Figure 3:
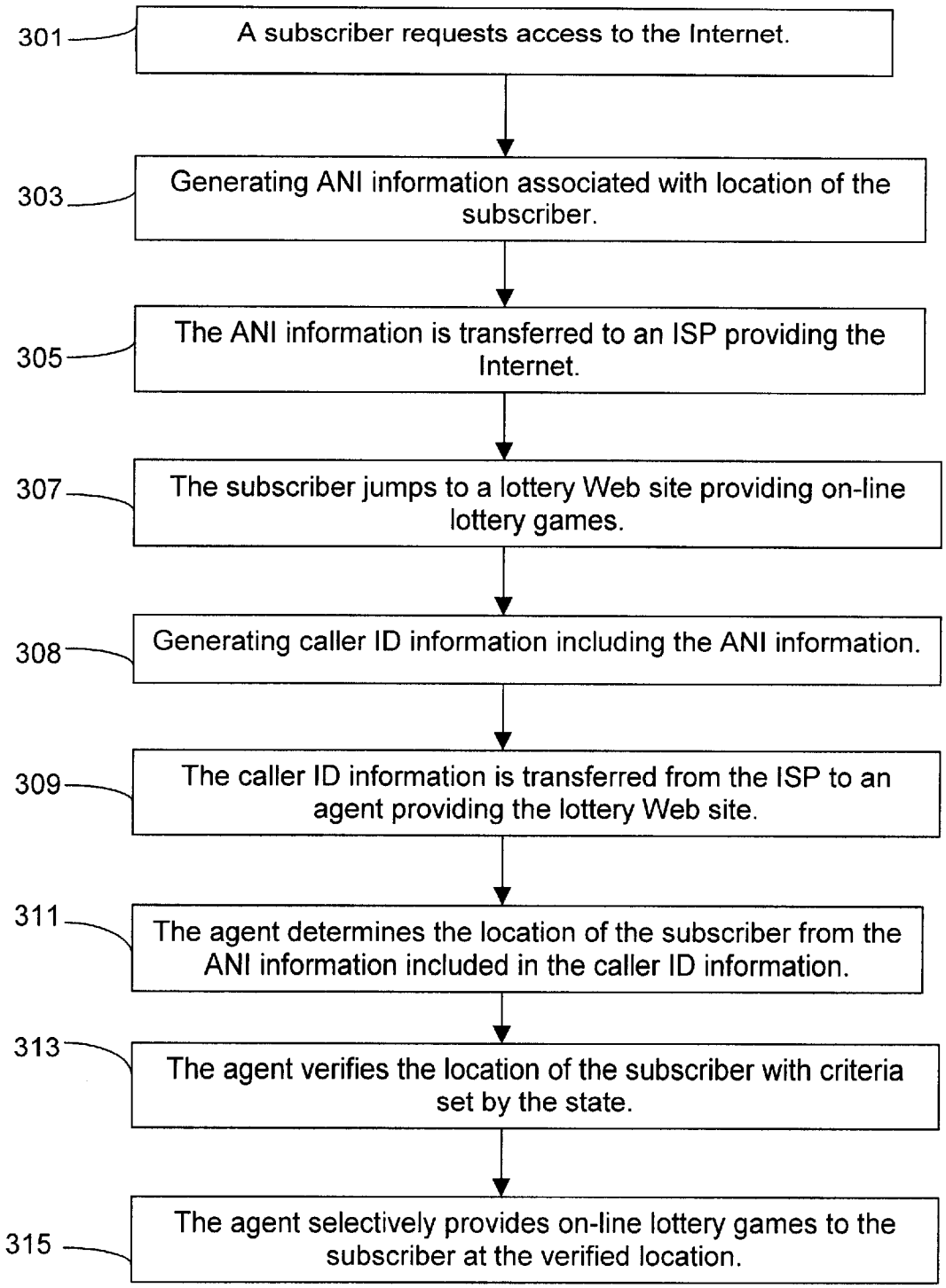
FIG. 3 is a series of steps describing a method for facilitating on-line lottery games according to the present invention.

Referring to FIG. 3, a series of steps describes a method for facilitating on-line lottery games over the Internet according to the present invention. The steps in FIG. 3 describe the method of the present invention especially with respect to verification of the location of a subscriber based on the criteria. At a terminal having capability of accessing the Internet, a subscriber requests access to the Internet (step 301). At this time, a telephone service provider generates ANI information associated with the location where the subscriber accesses the Internet (step 303). As being described above, ANI is a service that provides the receiver of a telephone call with the number of the calling phone. Upon the subscriber's access to the Internet, the ANI information is transferred to an Internet service provider (ISP) providing the Internet (step 305). The subscriber jumps to a lottery website on which an agent provides various on-line lottery games, including governmental lottery games offered by the states via the Internet (step 307). At this time, the ISP generates caller ID information including the ANI information (308). When the subscriber is routed to the agent providing the website, the caller ID information is transferred to the agent (step 309). The caller ID information may include other information associated with the subscriber, such as name, address, age, password, and so on, which may have been entered into the ISP at the time of subscribing to the Internet service.

Upon receiving the caller ID information, the agent determines the location of the subscriber from the ANI information included in the caller ID information (step 311). The agent then verifies the location of the subscriber with the criteria (step 313). This verification will be described in detail below. The criteria may be certain requirements set and provided by the state for playing lottery games sponsored by the state. Upon verifying the location of the subscriber, the agent provides on-line lottery games to the subscriber at the verified location (step 315).

Figure 4:
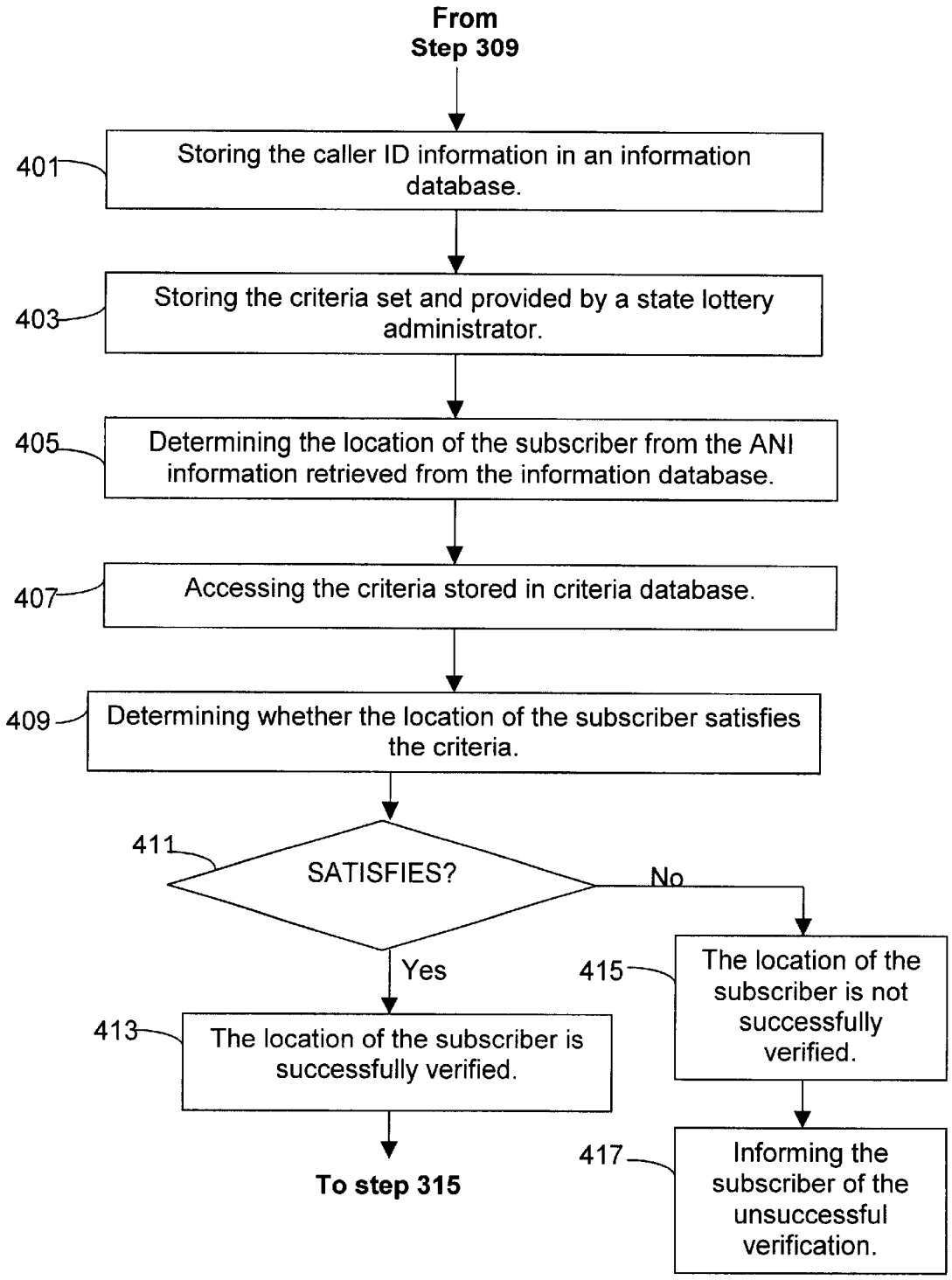
FIG. 4 is a series of steps describing in more detail steps 311 and 313 in FIG. 3.

Referring to FIG. 4, a series of steps describes in more detail the verification of the location of the subscriber (steps 311 and 313) in FIG. 3. Upon receiving the caller ID information from the ISP, the agent stores the caller ID information in an information database (step 401). The criteria provided by the state is transferred and stored in a criteria database in the agent (step 403). It need be noted that the criteria may be stored in the criteria database at any prior time. That is, the agent may have pre-existing criteria database that has been previously provided by the state. The agent server then determines the location of the subscriber by use of the ANI information extracted from the caller ID information stored in the information database (step 405). The agent also accesses the criteria stored in the criteria database (step 407). With the determined location of the subscriber and the criteria, the agent determines whether the location satisfies the criteria (step 409). That is, the agent determines whether the location falls within the borders of the state set forth in the criteria.

If the agent determines that the location satisfies the criteria (step 411), the location of the subscriber is successfully verified (step 413). On the contrary, if the agent determines that the location does not satisfy the criteria (step 411), the location of the subscriber log-on place is not successfully verified (step 415). In this case, the agent informs the subscriber of the unsuccessful verification, that is, failure to jump to the lottery website (step 417). Upon such verification, the agent provides the verified subscriber with various lottery games. In other words, only the subscriber who logs on to the Internet at a terminal of which location satisfies the criteria, may play the on-line lottery games.

Although having described that a subscriber enters the subscriber information at the time of accessing the Internet and the subscriber information is transferred to and stored in an Internet service provider, a subscriber may provide the subscriber information to an agent server to log in to an on-line game website operated by the agent server. An exemplary description of registration on a website and play of on-line games follows.

Figure 5:
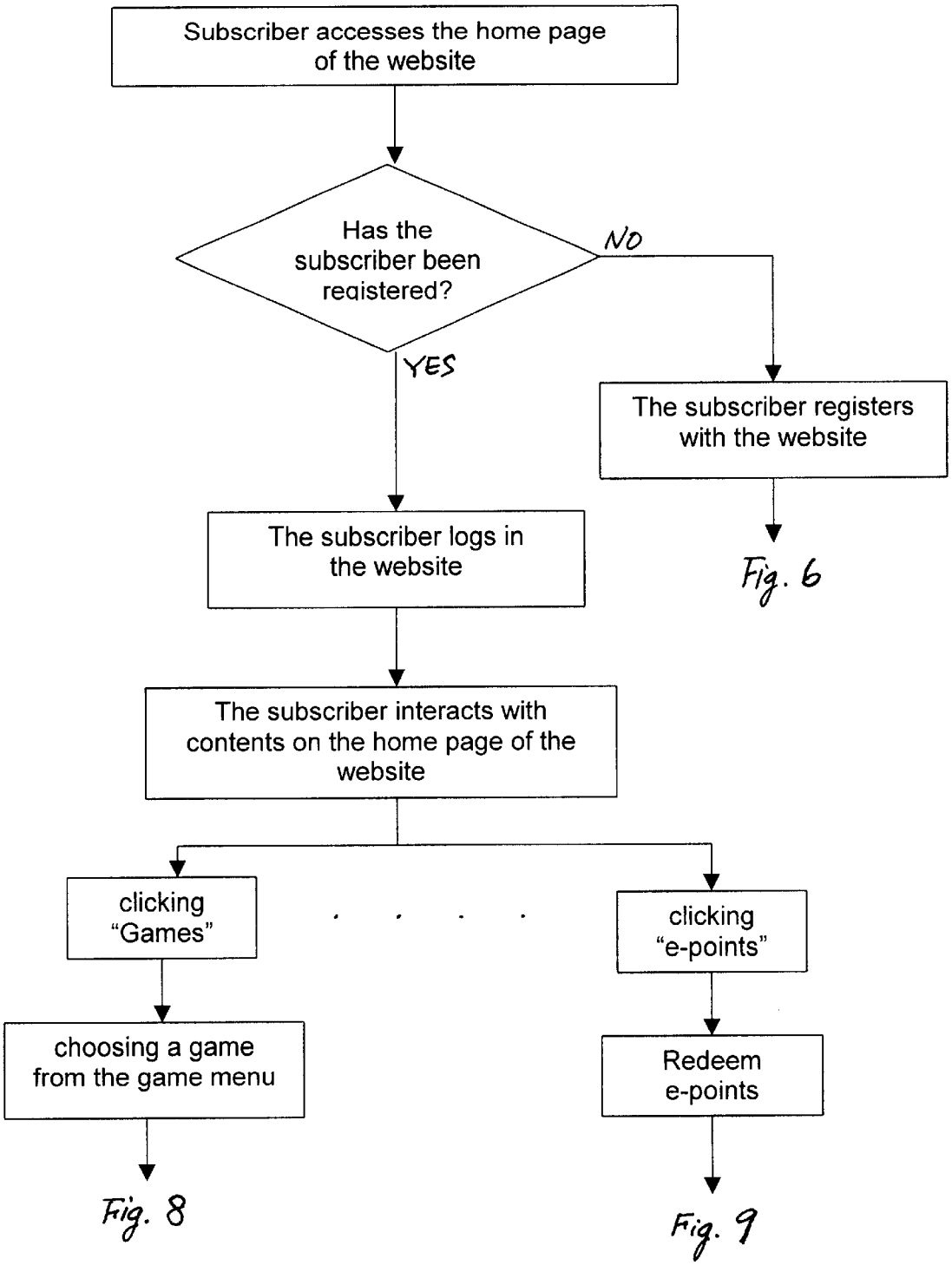
FIG. 5 is a flowchart describing an example of registration and on-line game play according to the present invention.

Referring to FIG. 5, upon logging on to the website providing on-line games, a subscriber can access a home page of the website. The home page may have various contents including hyperlinks to jump to other pages of the website and hyperlinks to jump to other websites. The hyperlinks to other websites may be "banners" of the Internet retailers and sponsors associated with the website. In order to interact with such contents on the website, the subscriber is required to register and be a member of the website. If the subscriber has not registered on the website, the subscriber can go to a registration page of the website by clicking a corresponding hyperlink. The subscriber becomes a member of the website by electronically submitting a registration form provided on the registration page on the website. An example of a registration page is shown in FIG. 6.

Referring to FIG. 6, a registration page of the website has a brief member questionnaire with blanks to be filled by the subscriber. The member questionnaire may request the subscriber to provide his/her information, such as e-mail address, name, date of birth, gender, address, telephone number, and so on. The subscriber may also be requested on the member questionnaire to make his/her own password. The subscriber may fill in the "password" blank with certain characters and/or numbers chosen for his/her password, and also fill in the "confirm password" blank with the same characters and/or numbers. By filling in the "password" and "confirm password" blanks, the subscriber may create his/her own password to be used on the website. The member questionnaire also includes a "password hint" blank where the subscriber may enter any words associated with the password that he/she has created. The password hint may be used to help the subscriber remember his/her password. In the member questionnaire, some information such as gender and telephone number may be optional so that the subscriber may skip the optional questionnaire. Address information may be used to confirm the subscriber's place of residence so as to determine whether the subscriber's residence is within the certain states. Telephone number information as well as the address information may be used to contact to the subscriber if he/she wins in the games provided on the website. Such information entered by the subscriber to answer to the member questionnaire may be stored as the subscriber information in an agent server providing the website. Thus, the agent server may use the subscriber information for the verification of the subscriber.

Figure 7:
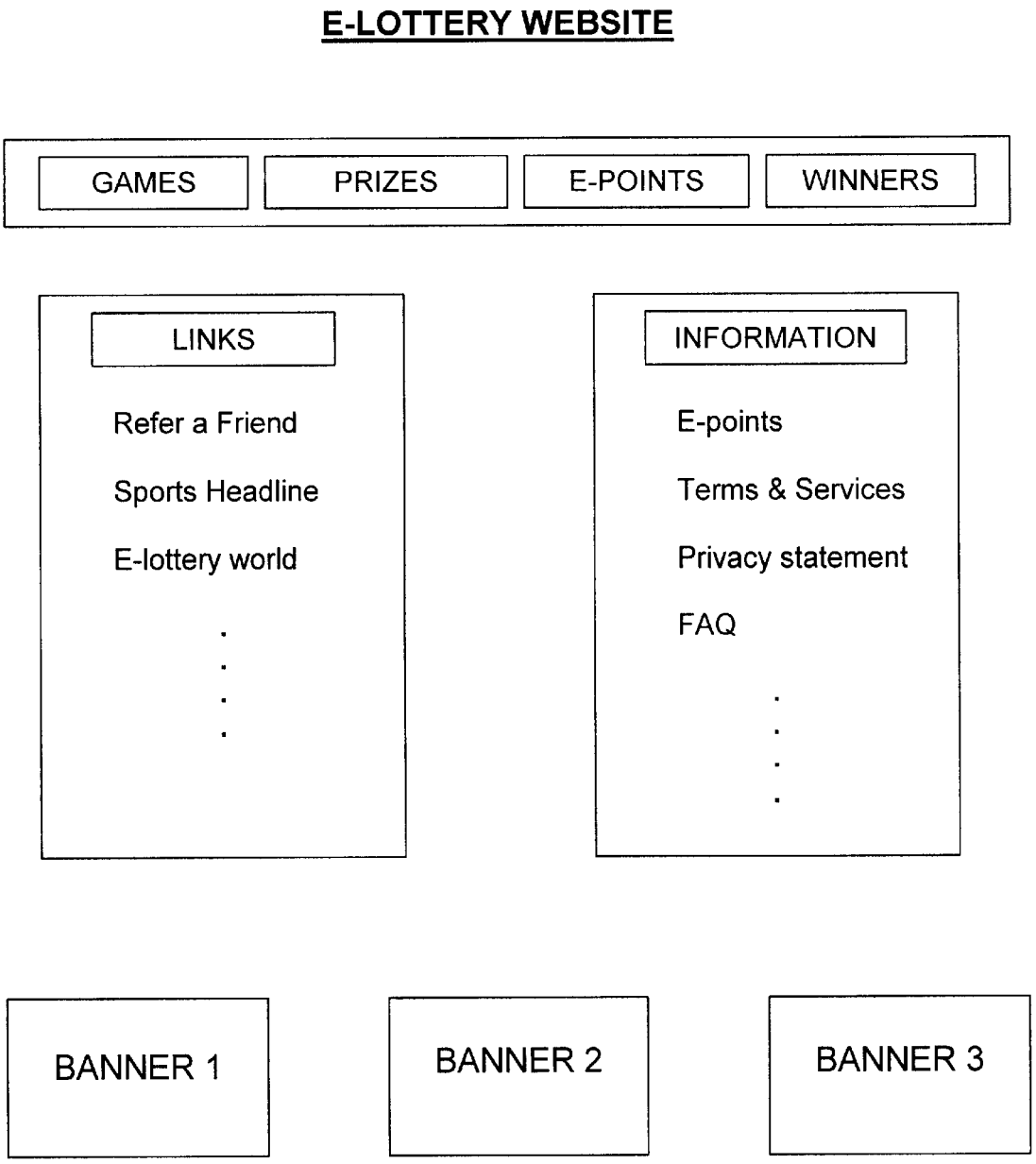
FIG. 7 illustrates an example of a home page of the website.

Referring again to FIG. 5, if the subscriber has registered on the website, he/she may log in to the website by entering user ID (identification) and password that he created at the time of registration. The subscriber's e-mail address may also be used as his/her user ID. Upon receiving the user ID and the password, the agent server accesses the subscriber information stored therein and retrieves information, such as address and age, necessary to verify the subscriber. Successful verification allows the subscriber to log in to the website and to interact with contents in a home page (or a predetermined starting page) of the website. FIG. 7 shows an example of the home page having various contents with which the subscriber interacts to play games and to receive rewards. Referring to FIG. 7, the contents on the page include hyperlinks of "games", "prizes", "e-points", and "winners" which are most frequently interacted by subscribers to play games and to get rewards. The contents may have hyperlinks to jump to other interesting websites or pages and also have information pages providing description of services on the website. The contents may also include advertising banners hyperlinked to retailers and sponsors associated with the website. By clicking a banner of the contents, the subscriber may jump to a website of an advertising retailer and interact with contents on the website of the retailer to purchase goods and/or services from the retailer.

Figures 8A, 8B:
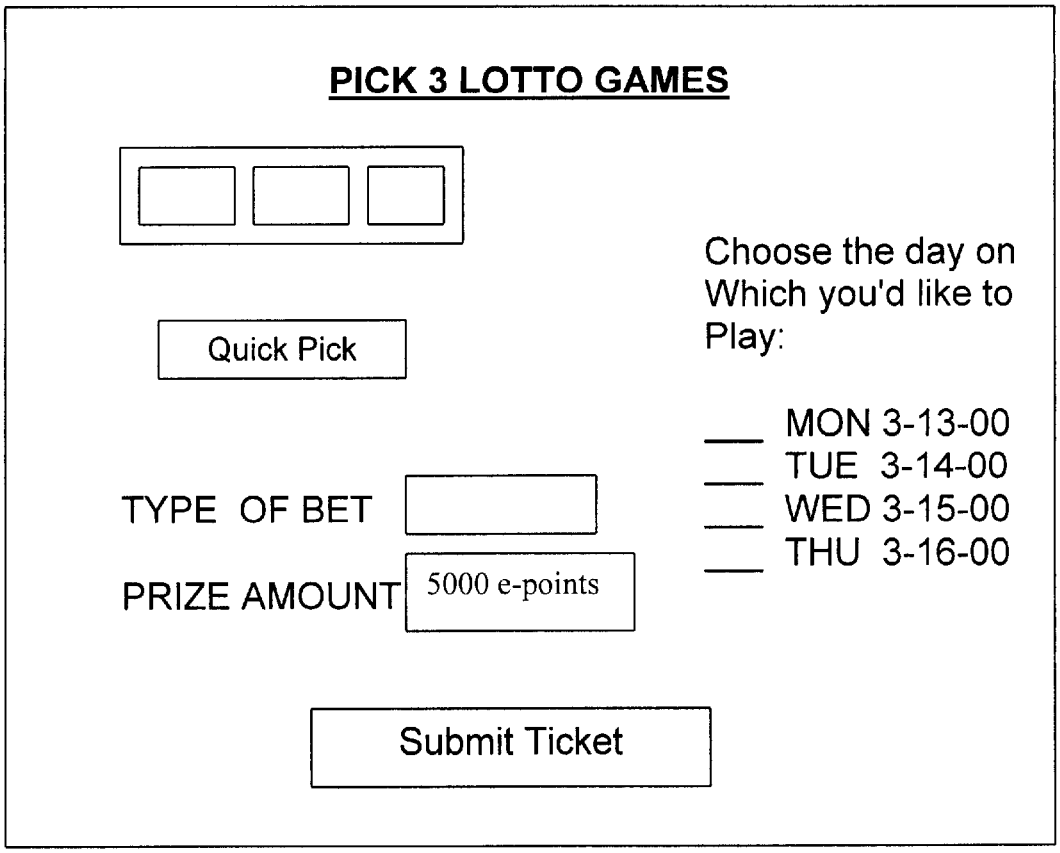
FIGS. 8A and 8B illustrate an example of an on-line game play provided on the website.

Referring to FIG. 5 again, upon accessing the home page of the website, the subscriber can jump to a game page to play games by clicking the "games" hyperlink. The game page may have a game menu where various games each having a title and/or a brief description are displayed. The subscriber can choose a game to play from the game menu. For example, if choosing a lotto game by clicking a corresponding hyperlink on the game menu, the subscriber jumps to a page providing the lotto game. FIGS. 8A and 8B show a lotto game as an example of consideration-based games available on the game menu of the website.

Referring to FIG. 8A, the lotto game page provides a virtual lottery ticket on which the subscriber can enter information such as lottery play numbers and a date of play. The subscriber may choose play numbers using a number pad (not shown) provided on the lotto game page or click "quick pick" button for a set of randomly generated numbers. The subscriber may also choose the date on which the subscriber would like to play. When the subscriber is satisfied with the play numbers, he/she may click "submit" button so that winning numbers are drawn and announced on the date chosen. Alternatively, instead of clicking the "submit" button, the subscriber may be required to click an advertising banner on the page. In other words, the subscriber may submit his/her lottery ticket by clicking a banner to jump to a hyperlinked website of a retailer or a sponsor. Referring to FIG. 8B, upon successfully submitting the lottery ticket, the subscriber receives a ticket confirmation number and ticket information. A prize for the winning may be specified on the ticket and/or the ticket information, and it may be a certain amount of e-points. Thus, the subscriber may earn e-points by winning on games provided on the website as well as by interacting with contents on the website as described above. The lotto game may be a governmental lottery game offered by the state via the Internet. In case of a governmental lottery game, the verification of the subscriber may be prerequisite for playing a lottery game.

Figure 9:
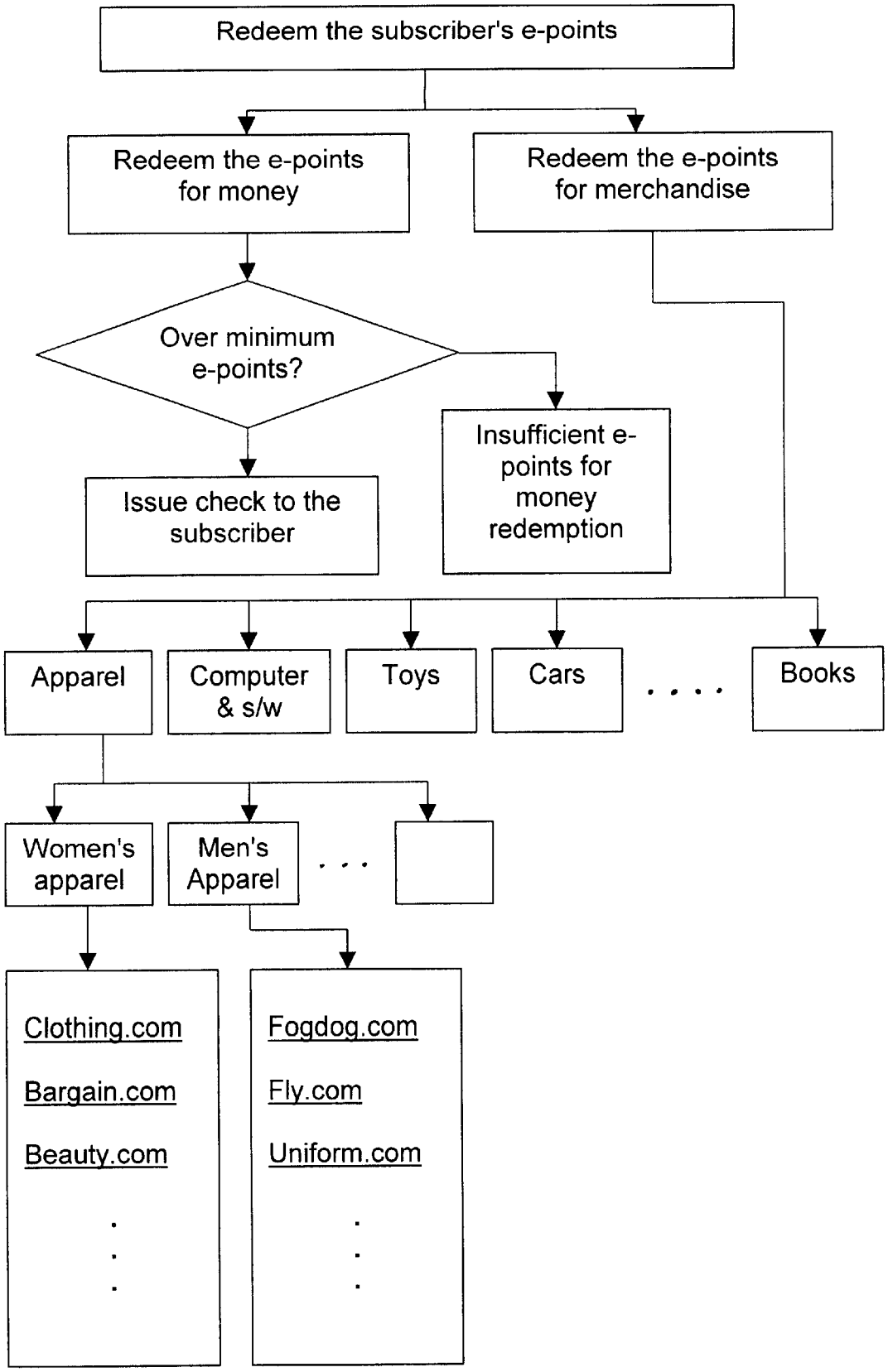
FIG. 9 is a flowchart describing an example of rewarding a subscriber according to the present invention.

Referring again to FIG. 5, upon successfully accessing the home page of the website, the subscriber may click "e-points" hyperlink to jump to a page relating to redemption of e-points earned by the subscriber. As shown in FIG. 9, the subscriber may have choices in the redemption of his/her e-points, such as redemption for money or for merchandise. If the subscriber chooses to be redeemed with money, the subscriber may be asked for his/her confidential password and other member information and it may be determined whether the amount of the subscriber's e-points is over a certain amount of redeemable minimum. If the amount of the subscriber's e-points is equal to or over the minimum, the subscriber's redemption amount is delivered to the subscriber via check in a certain time period. If the amount of the subscriber's e-points is less than the minimum, the subscriber receives a message informing insufficient e-points for the money redemption. The subscriber may also choose to redeem his/her e-points for merchandise. In this case, the subscriber may receive, for example, rebate checks in accordance with his/her redemption amount on goods and services offered by the Internet retailers hyperlinked with the website. The subscriber may also choose a category of merchandise for the redemption, and further choose more specified types of merchandise within the category chosen. Each of the specified types of merchandise displays URL (Uniform Resource Locator) addresses of various retailers. Since the URL addresses are hyperlinked with the website, the subscriber can directly jump to a website of his/her favorite or interesting retailer by clicking a corresponding one of the URL addresses. On the website of a retailer chosen, the subscriber may order goods or services of which value is equal to or less than his/her redemption amount, or the subscriber may receive a discount as much as the redemption amount. See commonly assigned patent application, on-line gaming system and method (attorney docket no. 8438-207), filed on the same day as the present invention, the disclosure in its entirety is incorporated by reference herein.

Having described preferred embodiments of a system and a method for facilitating on-line lottery games according to the present invention, it is noted that modifications and variations can be made by persons skilled in the art in light of the above teachings. For example, the verification may be performed with respect to subscriber's personal information such as age, name and so on, in addition to the location of the subscriber.

Accordingly, it is not intended that the scope of the claims appended hereto is limited to the description as set forth herein, but the claims should be construed as encompassing all features that would be treated as equivalent to those of the present invention by those skilled in the art.

What is claimed is:

1. A system for facilitating lottery game play over an electronic network, comprising:

a plurality of terminals each having a modem for connecting to a service provider server providing the electronic network, the service provider server receiving player information from a player and location information associated with location of the player from a telephone service provider when the player requests access to the electronic network from one of the terminals; and an agent server for storing criteria required for playing the lottery games, the agent server being connected to the service provider server for receiving the player and location information when the player is routed to the agent server from the service provider server, for verifying the player and location information with the criteria, and for providing lottery games to the player.

2. The system as defined in claim 1, wherein the agent server includes:

a first database for storing the criteria required for playing the lottery games;

a second database for storing the player and location information received from the service provider server;

a verification unit for verifying the player and location information with the criteria; and a data process unit for providing control and data signals to the first and second databases and the verification unit.

3. The system as defined in claim 2, further including a game server for providing the lottery games to the player of the verified information through the electronic network under control of the data process unit.

4. The system as defined in claim 2, wherein the criteria include borders of certain state within which the player of the verified information is located.

5. The system as defined in claim 4, wherein the location information is associated with a terminal at which the player accesses the electronic network.

6. The system as defined in claim 2, wherein the location information includes automatic number identification (ANI) information, and the verification unit determines location of the player using the ANI information.

7. The system as defined in claim 6, wherein the telephone service provider generates the ANI information to the service provider server.

8. The system as defined in claim 1, wherein the player requests are in Hypertext Transfer Protocol (HTTP) format.

9. The system as defined in claim 1, wherein the criteria is set and provided by a state lottery administrator supervising state-sponsored lottery games.

10. The system as defined in claim 1, wherein the electronic network includes a global computer network.

11. A system for facilitating lottery games over an electronic network, comprising:

at least one terminal at which a player requests access to the electronic network;

a network provider for providing the electronic network, the network provider including:

means for receiving ANI information associated with location of the player from means for providing a telephone service to the player; and means for receiving player identification (ID) information associated with the player from the player;

a first database for receiving and storing the ANI information and the player ID information;

a second database for storing criteria setting forth requirements for playing the lottery games;

means for verifying the ANI information and the player ID information with the criteria; and means for selectively providing the lottery games to verified player.

12. The system as defined in claim 11, wherein the means for verifying includes:

means for determining location of the player from the ANI information; and means for determining whether the location of the player falls within area designated in the criteria.

13. The system as defined in claim 11, wherein the electronic network is a global computer network, and the lottery games are provided on a website over the global computer network.

14. The system as defined in claim 13, wherein the ANI information is provided to the network provider when the player accesses the global computer network, and the player ID information is provided to the network provider when the player is routed to the website.

15. A method for facilitating lottery games over an electronic network provided by a network provider, comprising the steps of:

accessing the electronic network at a terminal for playing the lottery games;

providing the network provider with a first information associated with a location of the terminal from a telephone service provider when a player at the terminal accesses the electronic network;

providing the network provider with a second information associated with the player from the player when the player is routed to an agent providing the lottery games over the electronic network;

receiving criteria setting forth requirements for playing the lottery games;

verifying the first and second information with the criteria; and providing the lottery games to the player of the verified information.

16. The method as defined in claim 15, wherein the step of verifying includes the steps of:

determining the location of the terminal from the first information; and determining whether the location falls within area designated by the criteria.

17. The method as defined in claim 15, wherein the first information includes ANI information generated by the telephone service provider.

18. The method as defined in claim 15, wherein the criteria is set and provided by a state lottery administrator supervising state-sponsored lottery games.

* * * * *